US005151565A

United States Patent [19]

Perret

[11] Patent Number: 5,151,565

[45] Date of Patent: Sep. 29, 1992

[54] MEDIUM TENSION CIRCUIT BREAKER

[75] Inventor: Michel Perret, Bourgoin-Jallieu, France

[73] Assignee: GEC Alsthom SA, Paris, France

[21] Appl. No.: 563,636

[22] Filed: Aug. 7, 1990

[30] Foreign Application Priority Data

Aug. 9, 1989 [FR] France ..... 89 10726

[51] Int. Cl.[5] ..... H01H 33/88

[52] U.S. Cl. ..... 200/148 A; 200/148 B; 200/148 R; 200/148 BV; 200/150 G

[58] Field of Search ..... 200/148 BV, 148 A, 148 B, 200/150 G, 148 R

[56] References Cited

U.S. PATENT DOCUMENTS

| | | | |
|---|---|---|---|
| 3,399,286 | 8/1968 | Kerr, Jr. | 200/144 |
| 3,408,468 | 10/1968 | Carter | 200/83 |
| 3,555,225 | 1/1971 | Safföld | 200/148 |
| 4,123,636 | 10/1978 | Cromer et al. | 200/148 A |
| 4,139,753 | 2/1979 | Cromer et al. | 200/148 A |
| 4,736,079 | 4/1988 | Soboul et al. | 200/148 A |

FOREIGN PATENT DOCUMENTS

| | | |
|---|---|---|
| 667602 | 11/1965 | Belgium . |
| 0152134 | 8/1985 | European Pat. Off. . |
| 0158482 | 10/1985 | European Pat. Off. . |
| 2809193 | 9/1979 | Fed. Rep. of Germany . |
| 3407858 | 8/1984 | Fed. Rep. of Germany . |
| 3636922 | 5/1988 | Fed. Rep. of Germany . |

*Primary Examiner*—A. D. Pellinen
*Assistant Examiner*—D Le
*Attorney, Agent, or Firm*—Sughrue, Mion, Zinn, Macpeak & Seas

[57] ABSTRACT

A medium tension circuit breaker comprising a casing of insulating material enclosing a gas having good dielectric properties and containing the following: first contacts connected to a first current terminal and second contacts connected to a second current terminal; a fixed arcing contact electrically connected to the first current terminal and a moving arcing contact fixed to a connecting rod mechanically connected to a drive member; and a moving permanent contact fixed to the moving arcing contact and providing an electrical connection between the first and second contacts when the circuit breaker is in the engaged position. The moving permanent contact is a short tubular part with the first and second contacts being disposed respectively on two circular arcs.

4 Claims, 3 Drawing Sheets

MEDIUM TENSION CIRCUIT BREAKER

The present invention relates to a medium tension circuit breaker in which electrical insulation is provided by a gas having good dielectric properties, such as sulfur hexafluoride $SF_6$.

BACKGROUND OF THE INVENTION

The invention relates more particularly to a circuit breaker in which a large current flows (several thousand amps). Circuit breakers of this type are to be found in power stations at the outlet of an alternator and upstream from a tension-raising transformer.

In circuit breakers of this type, the permanent moving contact through which the permanent current flows is generally a copper tube of relatively high mass which is driven at very high speed together with the arcing contact when breaking the circuit. The drive energy required for this operation is large since it is proportional to the product of the mass of the moving equipment multiplied by the square of the speed at which said equipment is displaced. All manufacturers seek to reduce this drive energy since large drive energy penalizes the cost of controlling the circuit-breaking apparatus.

A first aim of the invention is to provide a circuit breaker in which the mass of the moving equipment is reduced, thereby obtaining a corresponding reduction in the drive energy required for a circuit breaking operation.

In known circuit breakers, the permanent current passes through sliding contacts; these contacts must be carefully made and this is reflected in the cost of the apparatus.

Another object of the invention is to provide a circuit breaker in which the permanent current does not flow through sliding contacts, thereby reducing the cost of the apparatus.

SUMMARY OF THE INVENTION

The present invention provides a medium tension circuit breaker comprising a casing of insulating material enclosing a gas having good dielectric properties and containing the following:

first contacts connected to a first current terminal and second contacts connected to a second current terminal;

a fixed arcing contact electrically connected to said first current terminal and a moving arcing contact fixed to a connecting rod mechanically connected to a drive member; and a moving permanent contact fixed to the moving arcing contact and providing an electrical connection between said first and second contacts when the circuit breaker is in the engaged position;

wherein said moving permanent contact is a short tubular part with said first and second contacts being disposed respectively on two circular arcs.

Advantageously, the angular extents of the circular arcs of the first and second contacts are about 120°.

Preferably, said moving permanent contact is connected to said second terminal by a metal braid.

A first embodiment of the invention includes a blast piston and cylinder for directing a jet of gas into the arcing zone.

In a variant, said fixed arcing contact and said moving arcing contact constitute portions of a vacuum interrupter connected firstly to said first terminal and secondly to said moving permanent contact.

BRIEF DESCRIPTION OF THE DRAWINGS

Embodiments of the invention are described by way of example with reference to the accompanying drawings, in which.

DETAILED DESCRIPTION

Figure 1:
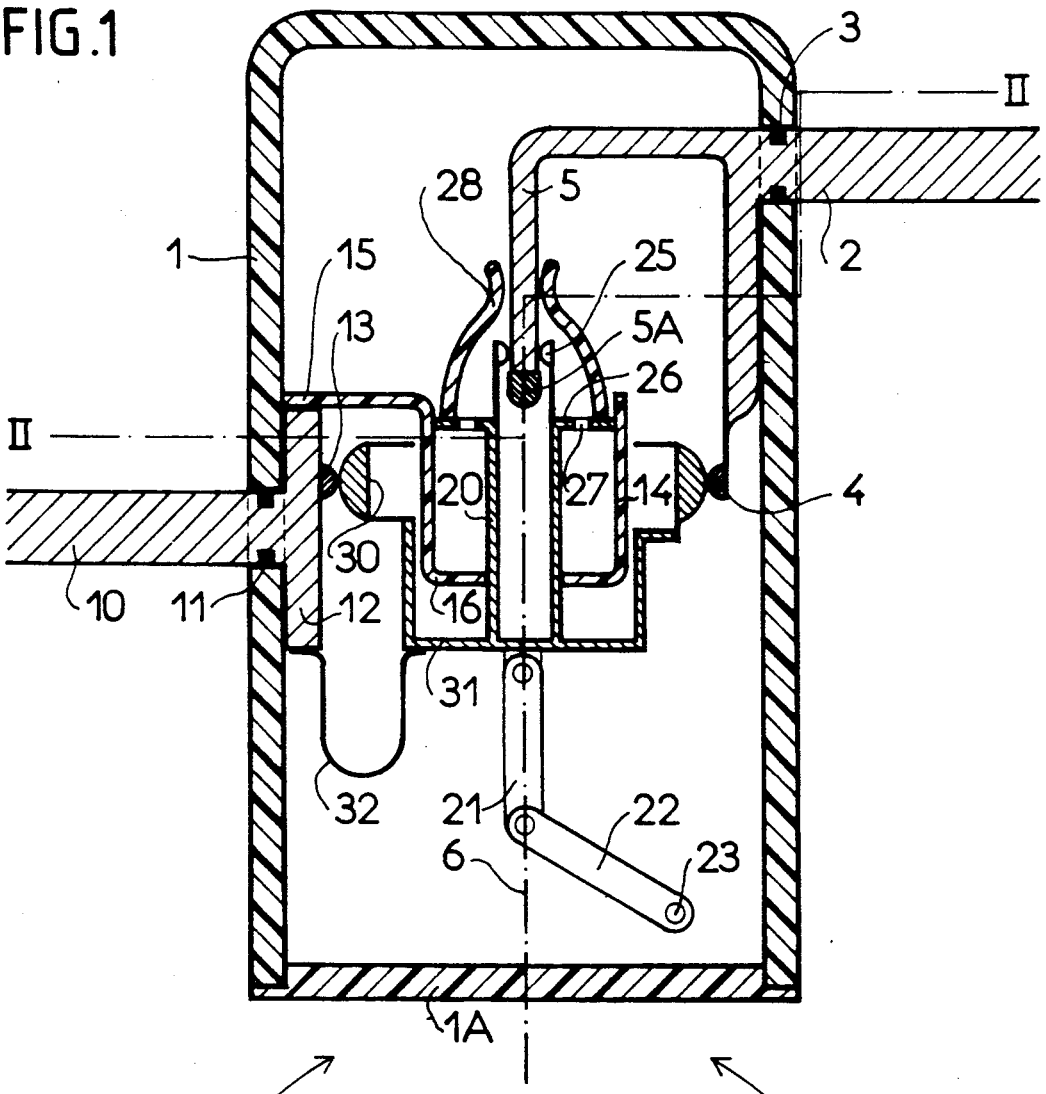
FIG. 1 is an elevation view in axial section through a first embodiment of a medium tension circuit breaker of the invention shown in its engaged position with the arc being extinguished by blasting.
Figure 2:
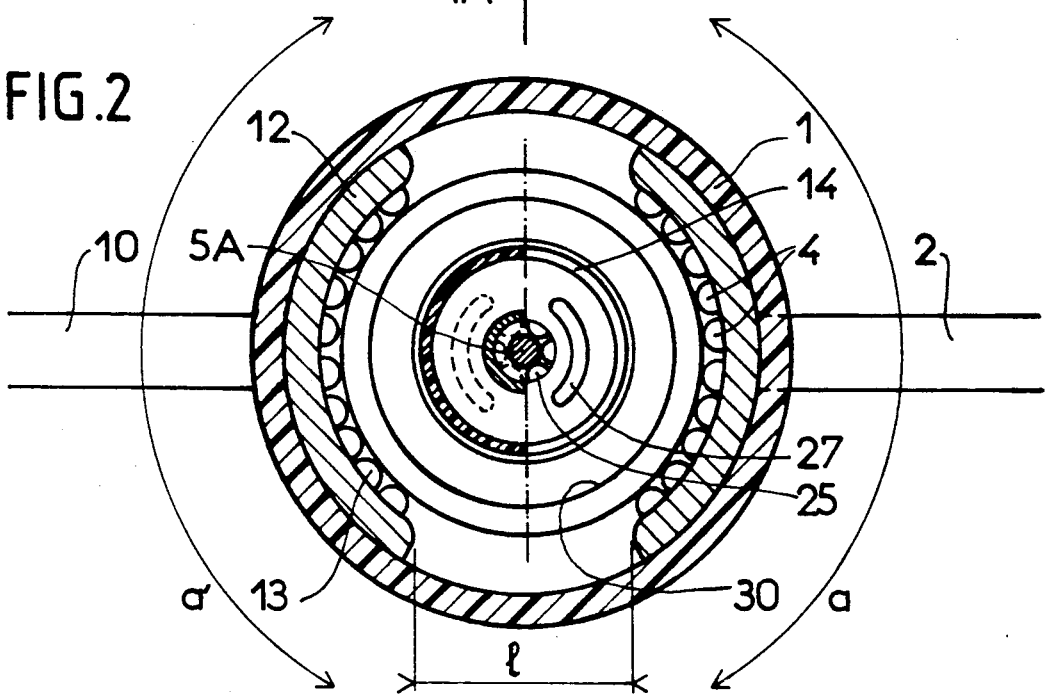
FIG. 2 is a cross-section view on line II—II of FIG. 1, with the blast nozzle omitted.
Figure 3:
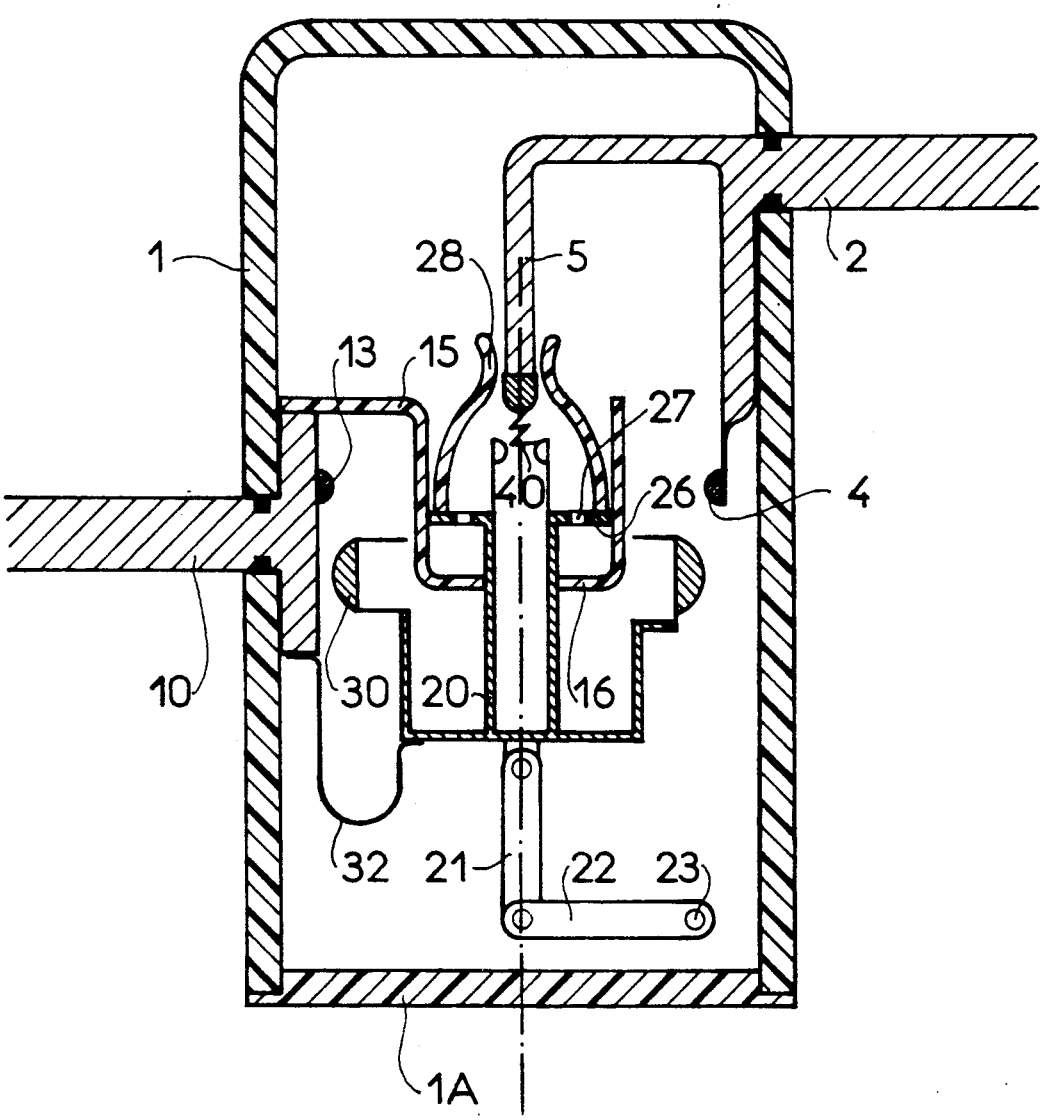
FIG. 3 is an elevation view in axial section through the same circuit breaker shown in the disengaged position.

In FIGS. 1 to 3, reference 1 designates a preferably cylindrical, gastight insulating casing provided with a bottom plate 1A and filled with a gas having good dielectric properties such as sulfur hexafluoride $SF_6$, at a pressure of one or more bars.

A first current terminal 2 connected upstream in the circuit to be protected passes through the casing 1 in sealed manner via a sealing ring 3. The terminal 2 extends inside the casing firstly in the form of a ring of fingers 4 and secondly in the form of a contact 5 disposed on the geometrical axis 6 of the casing. The fingers 4 are disposed in the vicinity of the wall of the casing, parallel to the axis 6, and occupy a circular arc a of about 120°, with the plane of said circle being perpendicular to the axis 6.

It is explained below how the upper limit on the extent of the above-mentioned circular arc can be determined accurately. The contact 5 is a metal rod terminated at one end 5A by an alloy which withstands the effects of electrical arcing, e.g. an alloy based on tungsten.

A second terminal 10 connected downstream in the circuit to be protected passes through the casing in sealed manner via a sealing ring 11, and it extends inside the casing 1 in the form of a cylindrical portion 12 carrying contact studs 13 disposed around a circular arc a' in a plane perpendicular to the axis 6, such that the studs 13 are diametrically opposite the ends of the fingers 4. The circular arc a' on which the studs 13 are disposed preferably extends over the same length as the arc a of fingers 4, and it is explained below how the upper limit on this length is determined.

The fixed assembly of the circuit breaker also includes a blast cylinder 14 made of insulating material, disposed coaxially about the axis 6, and fixed to the wall by tabs 15, with the blast cylinder 14 having a bottom 16 with an opening through which a part of the moving equipment passes.

The moving equipment comprises a metal tube 20 which extends through the above-mentioned opening through the bottom 16 and which is fixed at a first end to a driving connecting rod 21 made of insulating material. The connecting rod 21 is hinged to a crank 22 rotated by a shaft 23 which passes through the wall 1 and which is connected outside the casing to a drive device (not shown).

The second end of the tube 20 carries a ring of contact fingers 25 constituting the moving arc contact and sliding on the fixed arc contact 5.

The tube 20 carries a blast piston 26 sliding inside the blast cylinder 14 and provided with calibrated openings 27.

A blast nozzle 28 of insulating material such as polytetrafluoroethylene (known under the registered trademark Teflon) is fixed to the piston 26.

The permanent moving contact is constituted by a copper tube 30 whose diameter is selected to co-operate with the fingers 4 and the studs 13 (when the circuit breaker is in the engaged position, see FIGS. 1 and 2). The tube 30 is fixed to the tube 20 by metal arms 31. A metal braid 32 connects one of the arms 31 to the upstream terminals 10–12.

The circuit breaker operates as follows:

In the engaged position, current flows from the upstream terminal 2, through the fingers 4, the tube 30, and the studs 13 to the downstream terminal 10.

The circuit breaker opening command causes the shaft 23 to rotate, which rotation is transformed by the crank 22 and the connecting rod 21 into translation movement of the tube 20 towards the bottom of FIG. 1. The contact 30 leaves the fingers 4 and the studs 13 and the current then switches to flow via the rod 5 and the fingers 25 sliding on rod 5. As the movement continues, the fingers 25 then leave the rod 5 and an arc 40 is struck (FIG. 3). The gas inside the cylinder 14 is compressed, and by escaping through the opening 27 and passing through the nozzle 28 it blasts the arc which is extinguished on the first zero crossing of the current.

By virtue of the very short length of the tube 30, the moving equipment is very light and, other things being equal, it requires less drive energy. It may also be observed that the permanent current passes through one set of contacts only with the design of the apparatus making it possible to omit any sliding contacts.

The angular extent of circular arcs a and a′ are selected to ensure that the circuit breaker has adequate voltage performance when in the disengaged position. Thus a minimum isolation distance l must be provided between the end fingers 4 and the closest end studs 13 (FIG. 2). Similarly, a minimum isolation distance must be ensured between the piston 26 or the tube 30 at the potential of the downstream terminal and the fingers 4 at the potential of the upstream terminal. The person skilled in the art knows how to calculate these distances as a function, in particular, of the nominal tension of the circuit breaker, of the inside diameter of the casing, and of the dielectric strength of the insulating gas used.

The braid 32 is used for passing current only during circuit breaking operation, when the tube 30 has disengaged itself from the fingers 4 and the studs 13. Current then flows via items 5A, 25, 20, 31 and the braid 32 connected to the terminal 10.

Figure 4:
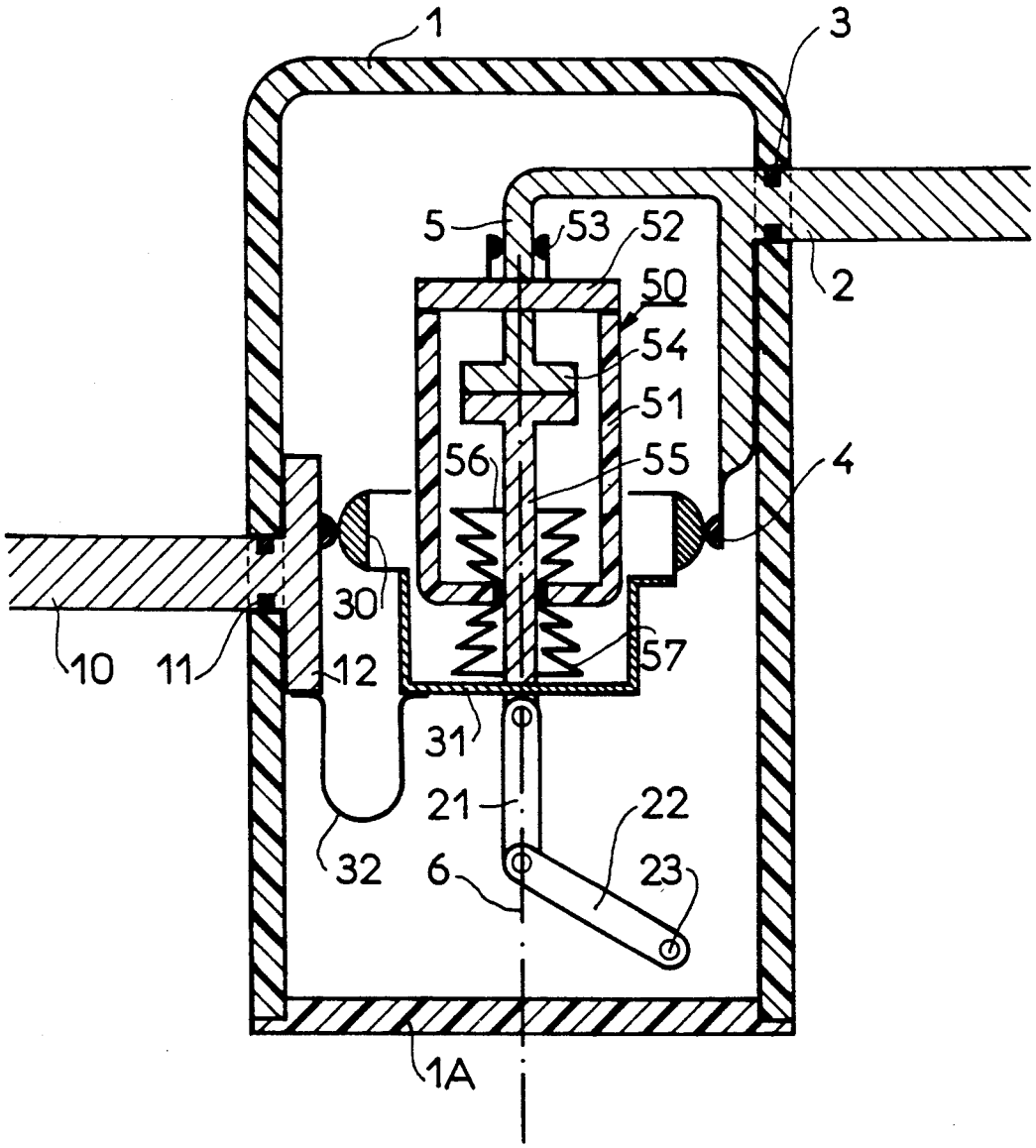
FIG. 4 is an elevation view in axial section through a variant embodiment of the invention in which the arc is extinguished by means of a vacuum interrupter.

In a variant, the blast piston and cylinder may be replaced by a vacuum interrupter. FIG. 4 shows a circuit breaker similar to that shown in FIGS. 1 to 3, but in which the cylinder 14, the piston 27, the tube 20, the contacts 5A and 25, and the nozzle 28 are all replaced by a vacuum interrupter 50 comprising:

an insulating housing 51;

a metal lid 52 connected to contact fingers 53 slidably engaging the rod 5;

a fixed arcing contact 54 inside the vacuum interrupter, a moving arcing contact 55, connected outside the vacuum interrupter to the drive connecting rod 21; and sealing bellows 56 and 57 sealing the interior of the vacuum interrupter 50 from the interior of casing 1.

This variant of the circuit breaker operates in entirely similar manner to that described above and has identical advantages.

The invention is applicable to making circuit breakers having a nominal tension of not more than 45 kV, and in particular power station circuit breakers.

It would also be possible to implement the invention when providing low tension circuit breakers insulated by air or by a gas having high dielectric strength.

We claim:

1. A medium tension circuit breaker comprising a casing of insulating material enclosing a gas having good dielectric properties and containing the following:

first contacts connected to a first current terminal and second contacts connected to a second current terminal;

a fixed arcing contact electrically connected to said first current terminal and a moving arcing contact in sliding contact with said fixed arcing contact and fixed to a reciprocable connecting rod mechanically connected to a drive member; and a moving permanent contact fixed to the moving arcing contact and providing an electrical connection between said first and second contacts when the circuit breaker is in the engaged position;

wherein said moving permanent contact is a short tubular part with said first and second contacts being stationary in a common plane and disposed respectively on two diametrically opposed circular arcs, and wherein the angular extent of each of the circular arcs of the first and second contacts is about 120°.

2. A circuit breaker according to claim 1, wherein said moving permanent contact is connected to said second terminal by a metal braid.

3. A circuit breaker according to claim 1, wherein said casing includes interiorly, a movable blast piston and an axially concentric fixed cylinder surrounding the piston for directing a jet of gas into an arcing zone.

4. A circuit breaker according to claim 1 wherein said fixed arcing contact and said moving arcing contact constitute portions of a vacuum interrupter and are respectively connected to said first terminal and to said moving permanent contact.

* * * * *